United States Patent [19]

Randles

[11] Patent Number: 4,590,745

[45] Date of Patent: May 27, 1986

[54] CARTON CLOSING MACHINE

[76] Inventor: Arthur E. Randles, 4617 S. 3rd Ave., Tucson, Ariz. 85714

[21] Appl. No.: 541,299

[22] Filed: Oct. 12, 1983

[51] Int. Cl.[4] ..... B65B 35/30

[52] U.S. Cl. ..... 53/541; 53/374; 53/377; 53/383; 198/461; 414/38; 414/92

[58] Field of Search ..... 53/374, 376, 377, 383, 53/541; 198/461, 491; 414/38, 92, 96

[56] References Cited

U.S. PATENT DOCUMENTS

| | | | |
|---|---|---|---|
| 2,904,941 | 9/1959 | Midnight | 53/387 X |
| 2,974,461 | 3/1961 | Demler | 53/383 X |
| 3,187,483 | 6/1965 | Steele et al. | 53/383 X |
| 3,348,655 | 10/1967 | Pierce et al. | 198/461 |
| 3,620,138 | 11/1971 | Neal et al. | 53/383 X |
| 3,627,100 | 12/1971 | Bourbina | 198/491 X |
| 4,006,575 | 2/1977 | Lee | 53/383 X |
| 4,124,113 | 11/1978 | Trees | 198/491 X |

*Primary Examiner*—John Sipos

*Assistant Examiner*—Steven P. Weihrouch

*Attorney, Agent, or Firm*—Melvin R. Stidham

[57] ABSTRACT

A carton closing machine including a longitudinal chain with lugs that carry the carton along a longitudinal path, folding down the carton top and passing the front flap thereof over a glue wheel to a cross-feed which carries the cartons laterally with the side flaps passing over a pair of glue wheels and into a rectangular stack defined by four vertical plates. An elevator raises each carton up into the stack to fold down the front and side flaps and then retracts to receive the next carton. Two pairs of belts at the upstream end of the machine carry the cartons to the conveyor chain and a backup chain with small lugs moves along with and between the second pair of belts to boost any carton that may slip on the surface of the belt. The first pair of belts is at a slightly higher elevation so that the backup lugs pass freely beneath cartons supported thereon to engage behind cartons on the second pair of belts.

4 Claims, 5 Drawing Figures

CARTON CLOSING MACHINE

BACKGROUND OF THE INVENTION

This invention is a feature of a machine for closing and sealing filled cartons of the type having a full lid, which is hinged at the back and has depending front and side flaps to be glued to the upright walls of the carton. Since the movement of the cartons must be timed with respect to devices that perform work on it, the machine requires a flighted conveyor, such as a continuous chain with lugs, to carry the cartons along. Generally, the cartons are delivered to the conveyor by means of a belt, and this presents problems in ensuring (1) that no more than one carton is delivered to a lug and (2) that a chain lug does not come up under a carton, possibly to damage it or cause a spill.

Generally, glue is applied to the carton by some means, such as a dauber, that applies the glue in a rather precise pattern away from the edges where it might extrude out to foul machine surfaces. However, there is a limitation to the speed at which such devices can be operated in order to avoid slinging glue.

OBJECTS OF THE INVENTION

It is an object of this invention to provide, in a machine performing work on a carton, a belt feed for a flighted conveyor that feeds no more than one carton to a lug.

It is a further object of this invention to provide a belt feed for a flighted conveyor that prevents chain lugs from coming up under a carton.

It is a further object of this invention to provide a flag infeed system that holds incoming cartons until ready to be received by a chain lug and then moves the lead carton away from the following cartons to facilitate stopping the next carton.

It is a further object of this invention to provide a box closing machine wherein glue is applied to the flaps in rapid succession and the flaps quickly folded down to adhere them to the sides.

It is a further object of this invention to provide a box closing machine wherein, although glue is applied to the flaps at high speed, means are provided to prevent glue from fouling critical machine surfaces.

It is a further object of this invention to provide, in a machine for closing cartons, means for making rapid adjustment of adhesive applicating devices.

Other objects and advantages of this invention will become apparent from the description to follow, particularly when read in conjunction with the accompanying drawing.

SUMMARY OF THE INVENTION

In carrying out this invention, I provide a table along which filled cartons are moved as the full lid, with front and side flaps, is folded down. The cartons are delivered to a positive feed system, including endless chains with lugs, by a belt infeed that ensures that a lug does not come up under the filled carton. The chains then carry the cartons past a first glue station wherein a strip of glue is applied to the underside of the front cover and then to a cross feed where a lateral positive feed device carries the carton toward a flap folding station after applying strips of adhesive to the undersides of the side flaps. At the folding station the cartons are raised in an elevator through a hopper or stack that folds the three flaps down until the adhesive sets. The sealed cartons are delivered in succession from the top of the stack.

DESCRIPTION OF A PREFERRED EMBODIMENT

Figure 1:
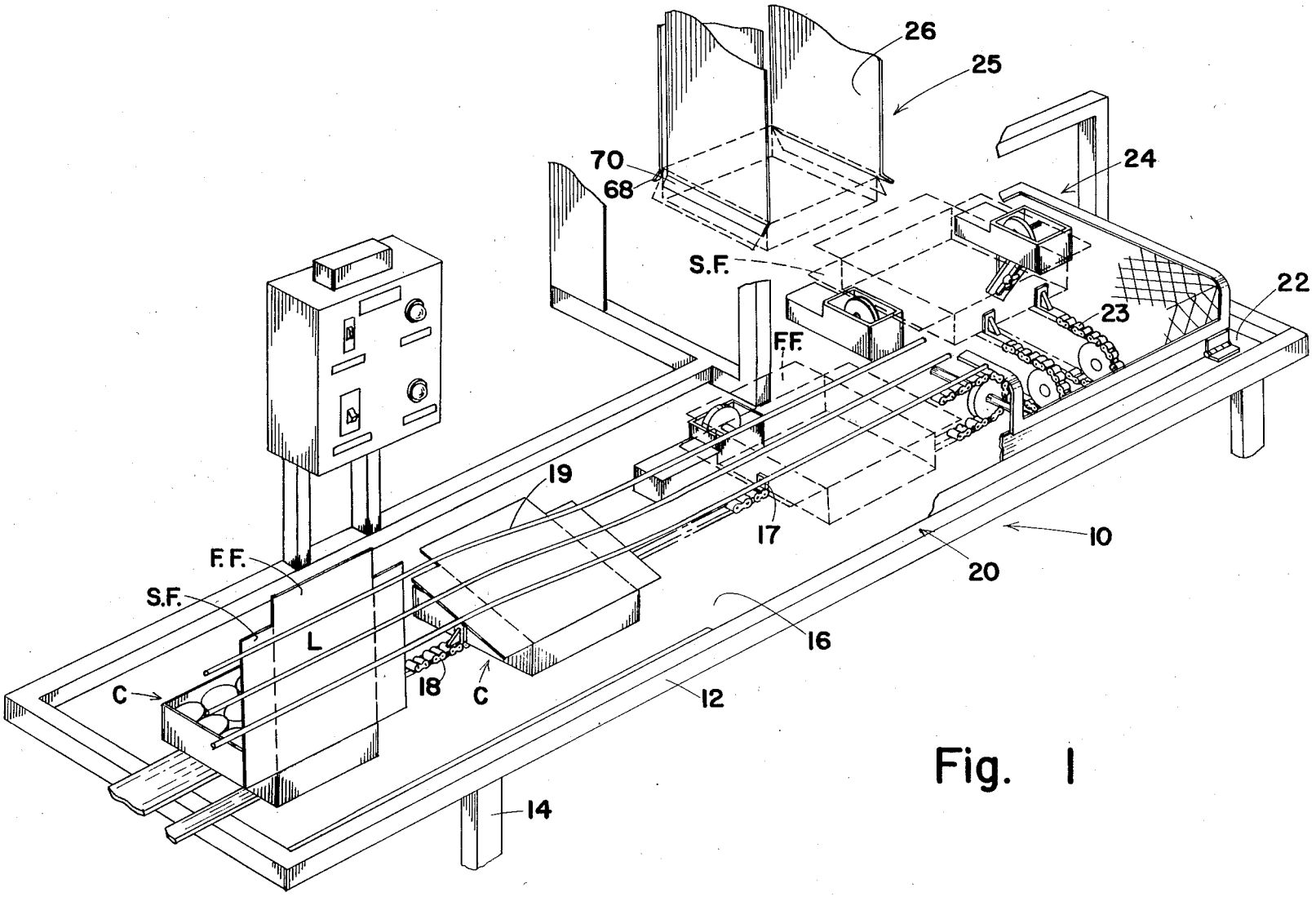
FIG. 1 is a view in perspective of the carton closing apparatus showing the sequence of operations.

Referring now to FIG. 1 with greater particularity, the carton closing apparatus 10 of this invention includes a frame 12 which is mounted on legs 14 or other suitable supports and, in turn, supports a table 16. As shown, filled cartons C are moved longitudinally along the table 16 by means of large lugs 17 carried at intervals along a chain 18 to fold down the lids L as the cartons pass under folding plows 19. With the lid L of a carton folded down, glue is applied at a first gluing station 20 to the front flap F.F. after which the carton C is delivered to a lateral table 22 wherein cross feed chains 23 carry the cartons past a second gluing station 24, at which adhesive is applied to both side flaps S.F. With all flaps F.F. and S.F. now glued, the cartons move to the flap folding station 25, wherein they are raised up through a stack 26 to fold the flaps F.F. and S.F. down against the sides of the carton C and adhere them thereto.

Figure 2:
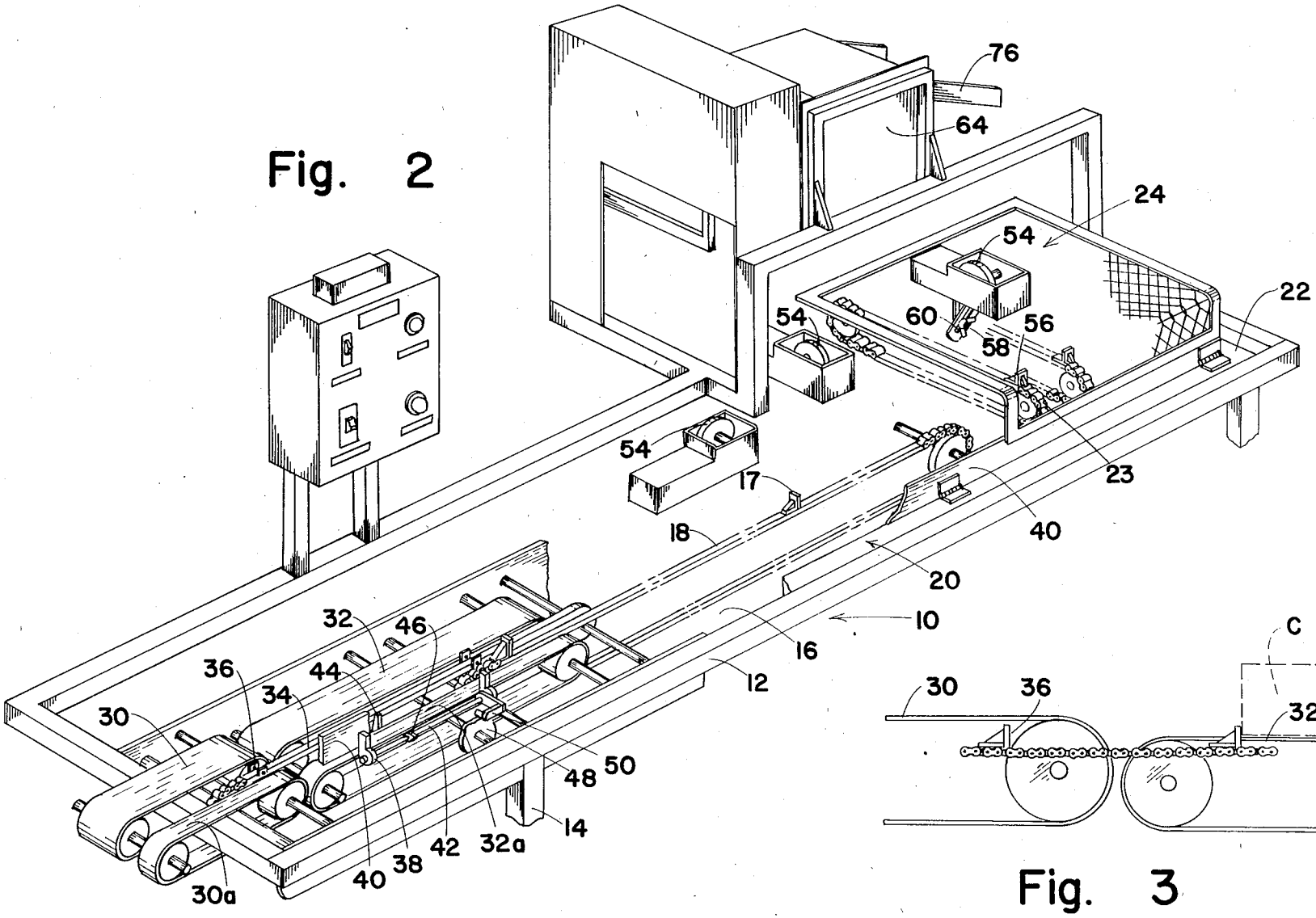
FIG. 2 is a view in perspective of the apparatus showing the longitudinal and cross feed systems.
Figure 3:
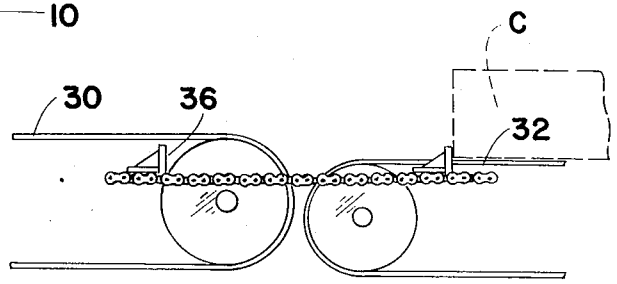
FIG. 3 is a partial side view showing the infeed conveyor means.

Referring now to FIG. 2, the cartons C are delivered to the lugs 17 of the positive feed endless chain 18 by means of a pair of infeed belts 30 and **30*a* and a pair of transfer belts 32 and 32*a*. Disposed parallel to and between the two pair of belts 30, 30*a* and 32, 32*a* is a positive feed backup chain 34 carrying spaced, relatively short lugs 36, which traverse below the level of the infeed or receiving belts 30 and 30*a* but above the surface of the transfer belt 32, 32*a*. Hence, the short lugs will pass below a carton C riding on the infeed belt without jarring it and possibly causing spills, but it will engage the trailing side panel of a carton C moving along the transfer belt 32**.

Mounted in bearings 38, which are carried on the outside of a carton guide rail 40 is a rocker shaft 42 carrying a flag or stop finger 44, which is positioned to engage the leading side panel of a carton when in its elevated position, and to release the carton when it is pivoted below the level of the transfer belt 32, **32*a*. The flag is slidable on the shaft 42 to be secured in a selected position thereon, as by means of an adjustment screw 46. In setting up the machine, the flag is positioned to engage in front of a carton, which is positioned on the transfer belt 32, with its trailing side surface engaging the upstream end of the receiving belt 30, with the tip of the flag in its lowest position, just below the level of the transfer belt 32**.

In operation, the transfer belts 32, **32*a* travel faster than the infeed belts 30, 30*a* so that, when the flag 44 releases a carton, the belts 32, 32*a* quickly separate it from the following carton on the slower infeed belts 30, 30*a*, enabling the flag to return and stop the following carton without difficulty. The rocking of the shaft 42 is accomplished by a cam 48 engaged by a cam follower 50 carried on the rocker shaft 42. Hence, in each rotation of the control cam 48, the shaft 42 is rotated partially to dip the flag 44 momentarily below the level of a carton and then return to engage the next carton. If a small lug 36 engages the bottom of a carton stopped by the flag 44**, it will simply slide under the carton until it moves in front of the flag.

After a carton has been released by the flag 44, the small lugs 36 on the backup chain 34 ensure that the carton moves along with the transfer belt 32 though there may be some tendency to slip on the belt. That is, the small lugs 36 ensure that the belts 32, 32*a* carry the cartons C in timed relationship with the main feed chain 18 to a point where the large lugs 17 pick them up and carry them through the lid closing plows 19 (FIG. 1) and the first adhesive station 20.

While any one of several adhering methods may be used, including hot sealing methods, spraying or the like, I have shown in this embodiment at each glue station a glue pot 52 in which is rotatably carried a glue wheel 54 that applies a strip of glue to the underside of a flap as it passes over and in engagement with it. Hence, at the first gluing station 20 the extended front flap F.F. passes over in engagement with the glue wheel 54 and the carton is delivered to the transverse feed table 22 with the lid L folded down and the front flap F.F. glued. This use of glue wheels instead of daubers or the like, enables the cartons to be fed at relatively high, continuous speeds, past the gluing stations 20 and 24 to the folding station 25.

The cross feed chains 23 with lugs 56 carry the carton laterally, as previously described over the glue wheels 54 at the second adhering station 24 wherein strips of glue are applied to the undersides of both side flaps S.F.

As shown at 58, the glue pots may be secured to the frame 12 of the machine by bolting it through a slot 60, which is disposed at a 45° angle. In most cartons C of the type here involved, the front and side flaps extend the full depth of the carton for maximum compression strength, as is desirable in carton stacking. Hence, when adjusting the machine for a change in carton, any change in elevation required for the glue wheels 54, will require a like lateral adjustment for proper placement of the glue strip on the laterally extending flaps F.F. and S.F. This is facilitated by the 45° angle slot.

Figure 4:
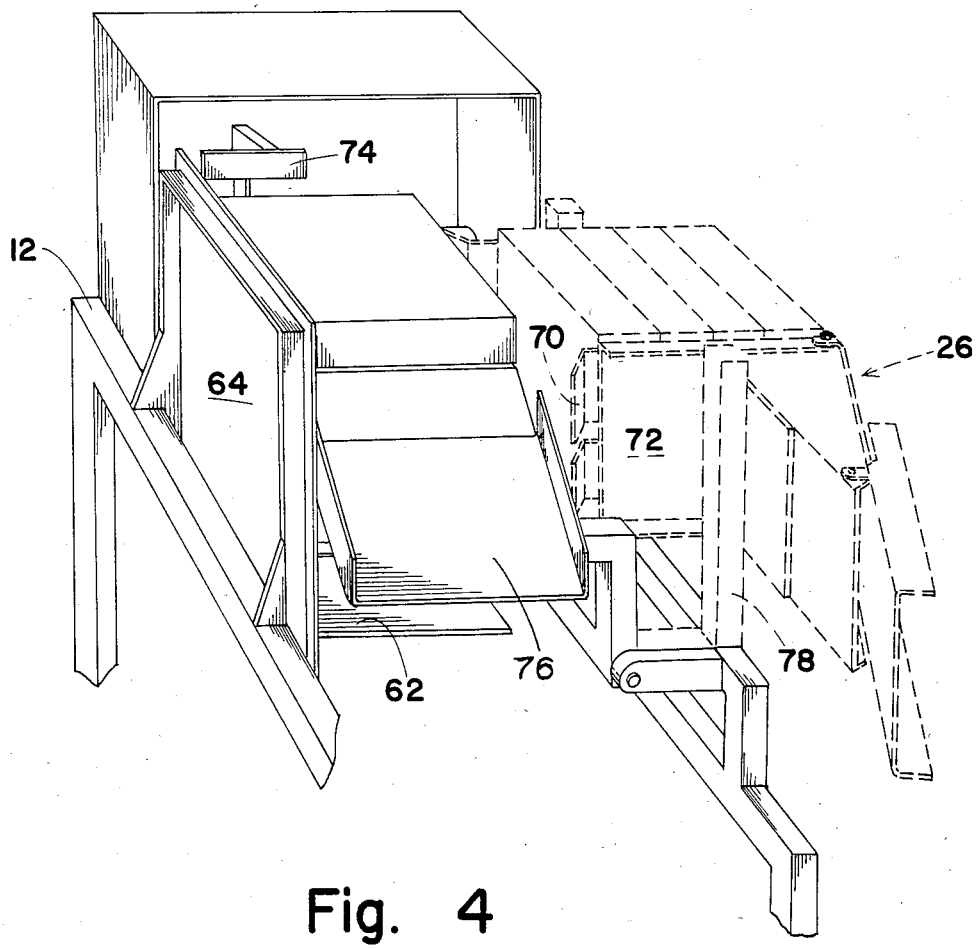
FIG. 4 is a view in perspective showing the flap folding system.
Figure 5:
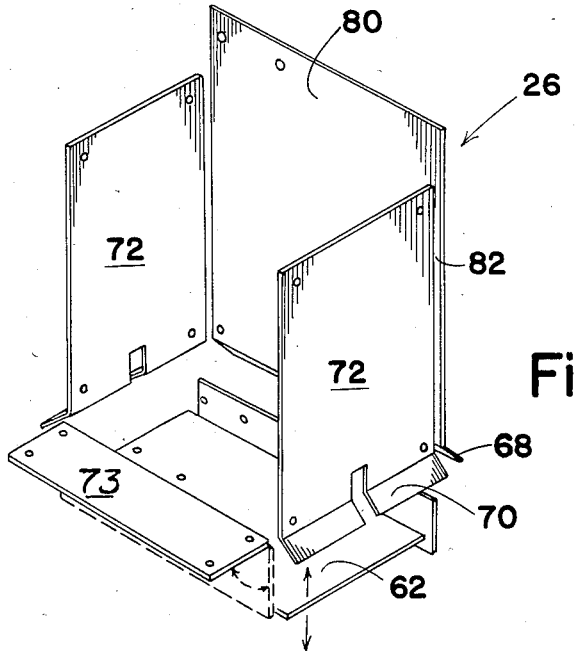
FIG. 5 is a view in perspective showing the flap folding stack.

After the glue is applied to the side flaps S.F. the carton is carried onto an elevator 62 (FIG. 4) being then positioned by a pivoted gate 63. The elevator 62 raises the carton a short distance up into the stack 26, wherein the front and side flaps are folded down by engagement with angled panels or plows 68 and 70 carried on the rear wall and side walls, respectively, of the stack 26. Then, as each carton is pushed up further by engagement of the next following carton, the flaps are held firmly to the carton by the side walls 72 and the rear wall 82 so that they are firmly set by the time they reach the top of the stack. There, an ejector pad 74 (FIG. 4) is operated by suitable cam means (not shown) to eject the top carton down a slide 76 for further packaging, as needed. As shown in FIG. 4, the stack 26 is carried on a sub-frame 78 so that it may be pivoted backward as indicated for cleaning and easy removal of cartons which may be contained therein when the machine 10 is stopped. As shown in FIG. 5 the panels 72 of the stack are separated from the back wall 80 and from the stationary front wall by gaps 82 so that any glue that may extend to the edges of the carton flaps F.F. and S.F. do not engage the surfaces of the stack 26.

While this invention has been described in conjunction with a preferred embodiment thereof, it is obvious that modifications and changes therein may be made by those skilled in the art to which it pertains, without departing from the spirit and scope of this invention as defined by the claims appended hereto.

What is claimed as invention is:

1. Apparatus for performing work on a carton, including a frame, a conveyor member on said frame with conveyor lugs thereon to engage an upright trailing panel of a formed carton to move said carton along a carton support surface from a pick-up point; and means for delivering cartons to said conveyor member comprising:

a pair of parallel, generally horizontal, receiving belts for receiving incoming cartons at one end of said apparatus;

a pair of parallel, generally horizontal smooth transfer belts immediately downstream of said receiving belts, and extending beyond said pick-up point alongside said conveyor member to deliver cartons thereto;

a back-up chain with transfer lugs thereon extending between and parallel to said receiving and transfer belts from ahead of the downstream end of said receiving belts to beyond said pick-up point;

said receiving belts being at an elevation so that said transfer lugs pass under cartons supported thereon and said transfer belts being at an elevation so that said transfer lugs extend above the surface thereof to engage the trailing panels of cartons supported thereon;

said transfer belts and said back-up chain being driven at the same velocity, greater than that of said receiving belts;

a shaft along and parallel to said transfer belts;

a stop arm slidable along said shaft;

means releasably securing said stop arm in a selected position along said shaft;

said stop arm being normally positioned to extend above the surfaces of said transfer belts in alignment with cartons thereon to be engaged by the leading panel of a carton supported thereon; and means for rotating said shaft partially at regular intervals to pivot said stop arm momentarily out of alignment with a carton on said transfer belts to enable said transfer belts to move said carton forward.

2. The apparatus defined by claim 1 wherein said conveyor member moves cartons in a longitudinal path along said carton support surface past one glue station and including:

a cross-feed chain beyond the downstream end of said drive chain having lugs thereon to engage an upright carton panel which is disposed parallel to said longitudinal path to move said carton in a lateral linear path past another gue station;

a first glue container mounted at one of said glue stations;

a first glue wheel rotatable in said first glue container on a horizontal axis normal to the adjacent path of carton movement to apply a line of glue across the front flap of a carton moving along said adjacent path;

second and third glue containers mounted at the other of said glue stations on opposite sides of the other path of carton movement;

second and third glue wheels rotatable in said second and third glue containers, respectively, on horizontal axes normal to said other path of carton movement to apply lines of glue to the side flaps of a carton moved thereby; and means for folding down said front and side flaps comprising:

a vertically reciprocating elevator at the downstream end of said lateral chain to receive cartons therefrom when in its down position; and a stack having vertical back and side walls extending upward from above said down position to engage and fold down the front and side flaps of a carton raised by said elevator;

said stack side walls being spaced from said back wall so that the edges of said side and front flaps do not engage a vertical wall of said stack;

said one glue station being situated near the downstream end of said longitudinal drive chain: and said cross-feed chain having a relatively short run to said elevator.

3. The apparatus defined by claim 2 including:

a sub-frame carrying said stack;

a vertical front wall mounted on said frame opposite said vertical back wall to restrain cartons being lifted in said stack; and hinge means mounting said sub-frame on said frame to enable said stack to be pivoted back away from said front wall.

4. A carton closing machine for closing a carton with a horizontal cover having a front flap and two side flaps joined to said cover by folding lines, comprising:

a frame;

a longitudinal drive chain movable on said frame and having lugs thereon to engage the trailing upright panel of carton and move said carton in a longitudinal path parallel to said front flap fold line along a carton support surface past one seal station;

a cross-feed chain beyond the downstream end of said drive chain having lugs thereon to engage an upright panel of said carton which is disposed parallel to said longitudinal path and move said carton in a lateral linear path past another seal station;

a first seal system at said one seal station operative to provide a line of adhesive material across the front flap of a carton moving along said adjacent path;

second and third seal systems at said another seal station operative to apply lines of glue to the side flaps of a carton moved thereby; and means for folding down said front and side flaps;

each of said seal systems comprising:

a glue container; and a glue wheel rotatable in said glue container about a horizontal axis normal to the direction of carton travel;

the periphery of said glue wheel being engageable by a flap of a carton moving thereby; and said means for folding comprising:

a vertically reciprocating elevator at the downstream end of said lateral chain to receive cartons therefrom when in its down position; and a stack having vertical back and side walls extending upward from above said down position to engage and fold down the front and side flaps of a carton raised by said elevator;

a sub-frame; a vertical front wall mounted on said frame opposite said vertical back wall to restrain cartons being lifted in said stack; and hinge means mounting said sub-frame on said frame to enable said stack to be pivoted back away from wall;

said stack side walls being spaced from said back wall so that the vertical edges of said side and front flaps do not engage a vertical wall of the stack;

said one glue station being situated near the downstream end of said longitudinal drive chain: and said cross-feed chain having a relatively short run to said elevator.

* * * * *